United States Patent [19]

Horsch

[11] Patent Number: 5,069,296

[45] Date of Patent: Dec. 3, 1991

[54] PITCH/TILT DOZER

[75] Inventor: Rudolf Horsch, Wausau, Wis.

[73] Assignee: Case Corporation, Racine, Wis.

[21] Appl. No.: 533,326

[22] Filed: Jun. 5, 1990

[51] Int. Cl.[5] ..... E02F 3/76

[52] U.S. Cl. ..... 172/825; 172/826; 37/DIG. 10

[58] Field of Search ..... 172/811, 824, 826, 825; 37/234, DIG. 10

[56] References Cited

U.S. PATENT DOCUMENTS

| | | | |
|---|---|---|---|
| 2,408,268 | 9/1946 | Peterson et al. | 172/826 |
| 2,485,407 | 10/1949 | Peterson | 172/826 |
| 3,653,451 | 4/1972 | Fryrear et al. | 172/824 |
| 3,662,841 | 5/1972 | Molby et al. | 172/824 |
| 4,621,696 | 11/1986 | Brouwer | 172/20 |
| 4,892,152 | 1/1990 | van Vuuren | 172/20 |

FOREIGN PATENT DOCUMENTS

| | | | |
|---|---|---|---|
| 0590406 | 1/1978 | U.S.S.R. | 172/826 |
| 0933887 | 6/1982 | U.S.S.R. | 172/826 |

*Primary Examiner*—David H. Corbin
*Assistant Examiner*—Jeffrey L. Thompson
*Attorney, Agent, or Firm*—Dykema Gossett

[57] ABSTRACT

An apparatus adapted to permit independent setting of pitch and tilt of dozer blades without necessitating complex hydraulic circuitry or mechanical linkage. The blade is pivotally supported by two forwardly extending push beams. A strut is connected at one end to one of the push beams and is connected at its other end to the dozer blade via a cam assembly. The cam assembly permits dozer blade pitching to take place without interacting with the dozer blade tilt angle. In a preferred embodiment, two struts are used at opposite ends of the blade and are each connected to their respective side of the blade by a respective cam. The two cams are linked together and synchronized so that their stroke equally pitches the sides of the dozer blade.

11 Claims, 3 Drawing Sheets

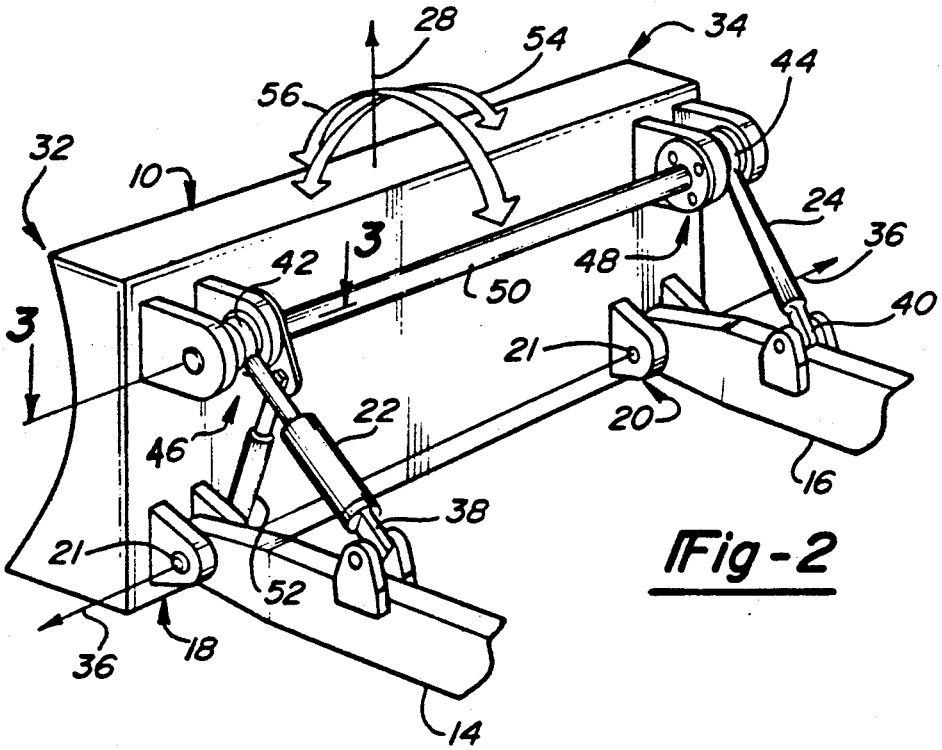
Fig-2
Fig-3
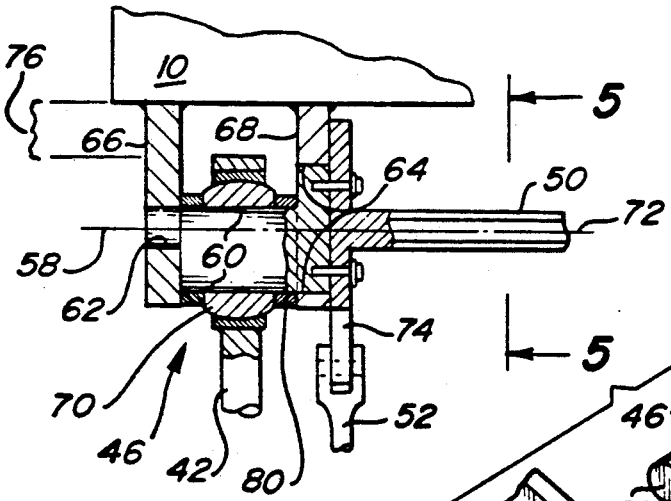
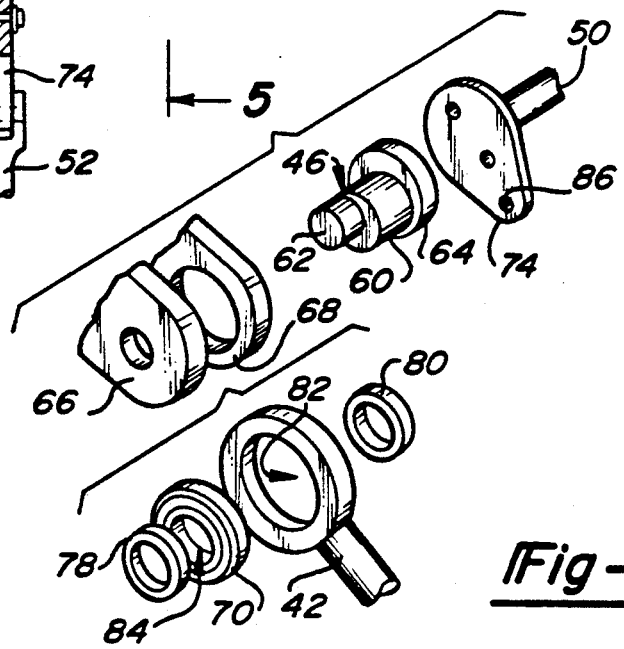
Fig-4

PITCH/TILT DOZER

BACKGROUND OF THE INVENTION

The present invention relates generally to a dozer blade mounting assembly and more specifically to a mounting assembly which allows the pitch of a dozer blade to be adjusted independently of the blade tilt angle.

There are many known techniques for adjusting the pitch and tilt of a dozer blade. For example, FIG. 1 depicts a well-known technique for effecting dozer blade tilt and pitch. In FIG. 1, dozer blade 10 is supported along its back surface 12 by push beams 14, 16. Push beams 14, 16 are fastened to back surface 12 by way of pivot hinges 18, 20. Hydraulic cylinder 22 is fastened to back surface 12 of dozer blade 10 by way of joint 23 and to push beam 14 by way of joint 27. Adjustable strut 24 is fastened to back surface 12 of dozer blade 10 by joint 25 and to push beam 16 by joint 29. Adjustable strut 24 is typically comprised of a turnbuckle, jack screw or the like which can be manually adjusted to change the overall length of strut 24. Hydraulic cylinder 22 is typically attached to the appropriate hydraulic circuit (not shown) which allows the length of cylinder 22 to be adjusted from a remote position. The conventional design depicted in FIG. 1 allows the pitch angle 26 of dozer blade 10 to be adjusted by setting the appropriate length of strut 24 and adjusting cylinder 22 to a comparable length. Thus, it can be appreciated that the greater the pitch angle between vertical axis 28 and back surface 12 of dozer blade 10, the greater cylinder 22 and strut 24 must deviate from a neutral (or center) position.

To effect tilt 30 of dozer blade 10, cylinder 22 is lengthened or shortened while strut 24 maintains a fixed length. For example, if cylinder 22 is lengthened (while strut 24 remained fixed), left corner 32 of dozer blade 10 will rise while right corner 34 of dozer blade 10 will remain substantially unaltered. Similarly, if cylinder 22 is shortened (while strut 24 remains fixed), left corner 32 of dozer blade 10 will lower while right corner 34 of blade 10 will remain substantially unaltered. Thus, it will be appreciated that the conventional design depicted in FIG. 1 can be used to alter the pitch 26 and tilt 30 of dozer blade 10.

Although the conventional design depicted in FIG. 1 is desirable because of its low cost and mechanical simplicity, it is not without its drawbacks. For example, it can be seen that there is an interdependence between setting pitch 26 and tilt 30. For example, if tilt 30 of blade 10 is set to its desired angle and thereafter pitch 26 is set, initial tilt angle 30 will be effected by virtue of the above-mentioned interaction between the pitch and tilt of blade 10. This interaction necessitates several interations between tilt and pitch adjustment before tilt and pitch can be adjusted to their desired set points.

Thus, in bulldozer designs which support the bulldozer blade via two main push beams, it can be seen that conventional designs which have kept the tilt/pitch mechanisms simple have not been altogether satisfactory in providing independently controllable pitch and tilt of the dozer blade.

Accordingly, it is an object of this invention to provide a simple mechanism for controlling the pitch and tilt of a dozer blade independent of one another. It is a feature of this invention to have the dozer blade joined to a support arm by way of a cam.

It is an advantage of this invention that when the cam is rotated about its rotational axis, the pitch of the dozer blade is changed independent of the tilt angle of the dozer blade.

SUMMARY OF THE INVENTION

In light of the foregoing objects, the present invention provides an apparatus for setting the pitch of a bulldozer blade which is mounted to a bulldozer by two spaced, forwardly extending push beams, each beam being pivotally attached to a respective side of the blade, thereby permitting the blade to pivot about an axis. The apparatus includes a support strut and a cam. The support strut has one end pivotally attached to the bulldozer and the remaining end attached to one surface of the cam. The cam has two rotational surfaces and a rotational axis. One of the rotational surfaces of the cam is concentric to the cam's rotational axis, and the other rotational surface of the cam is eccentric to the cam's rotational axis. One of the rotational surfaces is rotationally mounted to the strut, and the remaining rotational surface is rotationally engaged to the dozer blade. The cam is rotatably engaged to the dozer blade spaced from the first axis of the blade. When the cam is rotated, the movement of the eccentric surface in relation to the concentric surface causes the blade to move relative to the support strut end, thereby changing the pitch of the blade by causing the blade to rotate about the blade's first axis. The movement of the cam thus allows the pitch of the blade to be adjusted regardless of the tilt of the blade.

In a preferred embodiment, the disclosed apparatus further includes a slave cam, a coupling shaft and a second support strut. The slave cam has a rotational axis, a surface concentric to the rotational axis and a surface eccentric to the rotational axis. The second support strut has one end pivotally attached to one of the push beams, and its second end is rotatably fastened to one of the surfaces of the slave cam. The remaining surface of the slave cam is rotatably fastened to the blade generally in vertical alignment with the end of the second strut which is attached to its respective push beam. The first strut has one end pivotally fastened to the remaining push beam, and its remaining end is rotatably fastened to one of the surfaces of the cam. The cam is fastened to the blade generally in vertical alignment with the end of the first strut which is attached to its respective push beam. The coupling shaft is joined to the cam and the slave cam generally in coaxial alignment with each cam's rotational axis. When the coupling shaft is rotated, the first and second cams rotate about their rotational axis, thereby causing the blade to rotate about its first axis and thereby changing the pitch of the blade.

Other advantages and meritorious features of the present invention will become more fully understood from the following description of the preferred embodiments, the appended claims and the drawings, a brief description of which follows.

BRIEF DESCRIPTION OF THE DRAWINGS

FIG. 2 is an isometric view of one embodiment of the apparatus of the present invention.

FIG. 3 is a partial top view of the cam assembly of the present invention taken substantially along lines 3—3 of FIG. 2.

FIG. 4 is an exploded view of the cam assembly of FIG. 3.

DETAILED DESCRIPTION OF THE PREFERRED EMBODIMENTS

Figure 1:
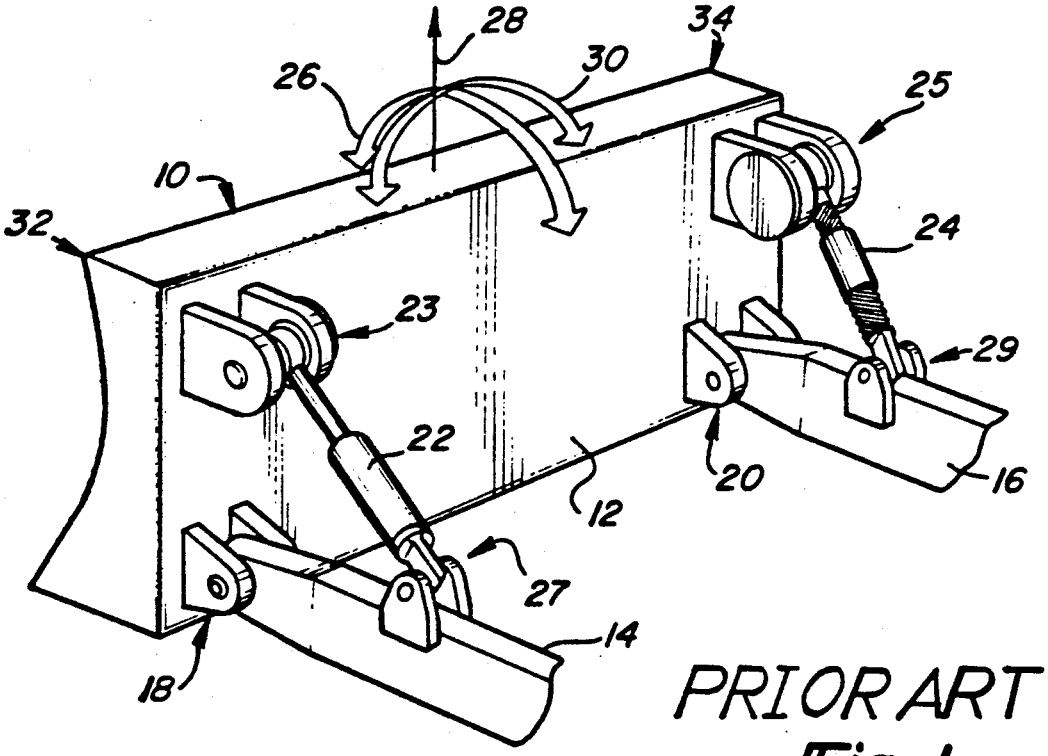
PRIOR ART Fig-1
FIG. 1 is an isometric view of a conventional bulldozer blade and the associated apparatus for tilting and pitching the blade.

Now referring to the drawing of FIG. 2, dozer blade 10 is supported by push beams 14, 16. Push beams 14, 16 are attached to dozer blade 10 by way of conventional pivot hinges 18, 20. Hinges 18, 20 are preferably coaxially aligned, thereby permitting blade 10 to pivot about their common axis 36 through pivot pins 21. Structs 22, 24 have respectively associated first and second ends. The first end of each strut 38, 40 is respectively pivotally attached to beams 14, 16. The second end of each strut 42, 44 is respectively associated with cams 46, 48.

Cams 46, 48 are joined by virtue of coupling shaft 50. Cams 46, 48 each have a rotational axis and two rotational surfaces, one rotational surface being concentric with the rotational axis and the remaining surface being eccentric with the rotational axis. Coupling shaft 50 is joined to each cam such that the longitudinal axis of shaft 50 is coaxial with the rotational axis of cams 46, 48. Means for rotating shaft 50 is provided by cylinder 52. Having discussed the elements of the disclosed apparatus, its operation to accomplish tilt and pitch of dozer blade 10 will now be explained.

As is generally known by those skilled in the art, blade tilt is the ability to adjust one corner 32 of dozer blade 10 above or below opposite corner 34 of blade 10. This adjustment would generally result in movement of blade 10 as depicted by arc line 54. Likewise, the pitch of blade 10 is generally set by rotating blade 10 about axis 36. Rotation of blade 10 about axis 36 would generally result in movement as depicted by arc line 56. When it is desired to tilt blade 10, hydraulic cylinder 22 is extended or contracted relative to strut 24. If, for example, cylinder 22 is extended, corner 32 would rise in relation to corner 34, thereby sloping blade 10 downwardly to the right (as viewed by the vehicle operator). Conversely, if cylinder 22 were contracted relative to strut 24, left corner 32 of blade 10 would drop, thereby causing dozer blade 10 to slope downwardly from right to left. In addition to controlling tilt 54 of blade 10, pitch 56 can be set independently of tilt. Setting the pitch 56 of blade 10 is accomplished with the disclosed apparatus by simply lengthening or shortening the stroke of hydraulic cylinder 52. When the stroke of cylinder 52 is changed, coupling shaft 50 rotates, thereby causing cams 46, 48 to rotate also. Because the two rotational surfaces of each cam 46, 48 do not share a common rotational axis, rotating each cam 46, 48 causes blade 10 to rotate about axis 36 whenever shaft 50 rotates. Thus, cylinder 52 can effect the pitch of blade 10. It is important to note in the disclosed embodiment of FIG. 2 that pitch adjustment is accomplished independent of tilt adjustment. This is accomplished by virtue of cams 46, 48 being identical in design and synchronized in their stroke so as to provide uniform indexing between second ends 42, 44 and blade 10. Thus, it can be appreciated that the embodiment disclosed in FIG. 2 provides a simple apparatus for adjusting the pitch of a dozer blade independent of the tilt setting of the blade.

Now referring to the drawing of FIG. 3, cam 46 includes a rotational axis 58, a rotational surface 60 eccentric to axis 58 and two rotational surfaces 62, 64 concentric with rotational axis 58. Concentric surfaces 62, 64 are rotationally engaged to blade 10 by respective mounting ears 66, 68. Concentric surfaces 62, 64 are adapted to freely rotate within respective ears 66, 68 and can be fitted therein by way of any suitable bearing means well known to those skilled in the art. Second end 42 of hydraulic cylinder 22 is rotationally engaged to eccentric surface 60 by way of ball joint 70. Ball joint 70 allows three degrees of freedom between eccentric surface 60 and end 42 (although in this embodiment a simple sleeve bearing will suffice). Three degrees of freedom are necessary at the points where push beams 14, 16 are mounted to the dozer frame (dozer frame not shown) because of the twisting experienced by one beam about the other during tilting. Cam 46 is fastened to shaft 50 in an orientation whereby the longitudinal axis 72 of shaft 50 is coaxial with rotational axis 58 of cam 46. By arranging the axes of these two members to coincide, any rotational forces exerted on shaft 50 will be impressed upon cam 46 in a way which causes cam 46 to rotate about its rotational axis 58. Cam 46 is fitted with an arm 74 to provide a lever arm for turning cam 46 and shaft 50. Arm 74 is attached to cylinder 52, thereby providing a means for rotating cam 46 and shaft 50. It can be easily seen from the drawing of FIG. 3 that when cylinder 52 is extended or contracted, arm 74 causes cam 46 to rotate about axis 58, and correspondingly, arm 74 causes shaft 50 to rotate about axis 72. Because surface 60 is eccentric to surfaces 62, 64, distance 76 will change depending upon the setting of cylinder 52. By varying distance 76, the pitch of blade 10 is altered. Inasmuch as the arrangement surrounding cam 48 is identical to the arrangement described in conjunction with FIG. 3, the rotation of shaft 50 imparts equal pitching motion on each respective corner 32, 34 of blade 10.

Now referring to the drawing of FIG. 4, mounting ears 66, 68 respectively engage concentric surfaces 62, 64 for providing a means for rotationally coupling cam 46 to blade 10. Second end 42 of cylinder 22 receives within its inner opening 82 ball joint 70. Ball joint 70 receives within its inner opening 84 eccentric surface 60 of cam 46. Spacers 78, 80 keep ball joint 70 centered between mounting ears 66, 68. Arm 74 is mounted to cam 46 via conventional fastening means such as bolts, rivets and the like. Arm 74 is fitted with hole 86 for providing a means of joining arm 74 to cylinder 52. It is not necessary to show the assembly and mounting of cam 48 inasmuch as it is identical to that of cam 46 as shown in FIG. 4.

Figure 5:
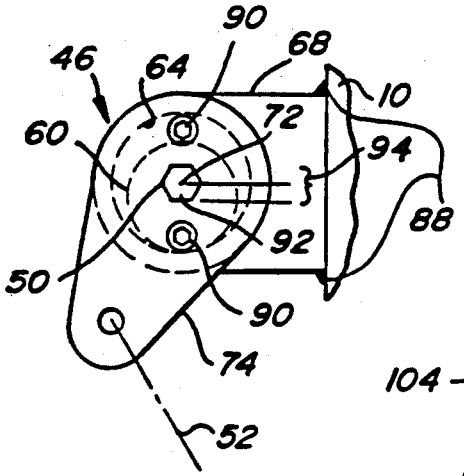
FIG. 5 is a side view of the cam assembly of the present invention taken substantially along lines 5—5 of FIG. 3.

Now referring to the drawing of FIG. 5, mounting ear 68 is shown fastened to blade 10 via welds 88 or any other conventional fastening means known to those skilled in the art. Cam 46 is shown exhibiting eccentric surface 60 and concentric surface 64. Arm 74 is attached to cam 46 via bolts 90. Shaft axis 72 is displaced from the center 92 of eccentric rotational surface 60 as evidenced by reference numeral 94. This difference 94 between axis 72 and center 92 is what permits relative motion between second end 42 of cylinder 22 and blade 10.

Figure 6:
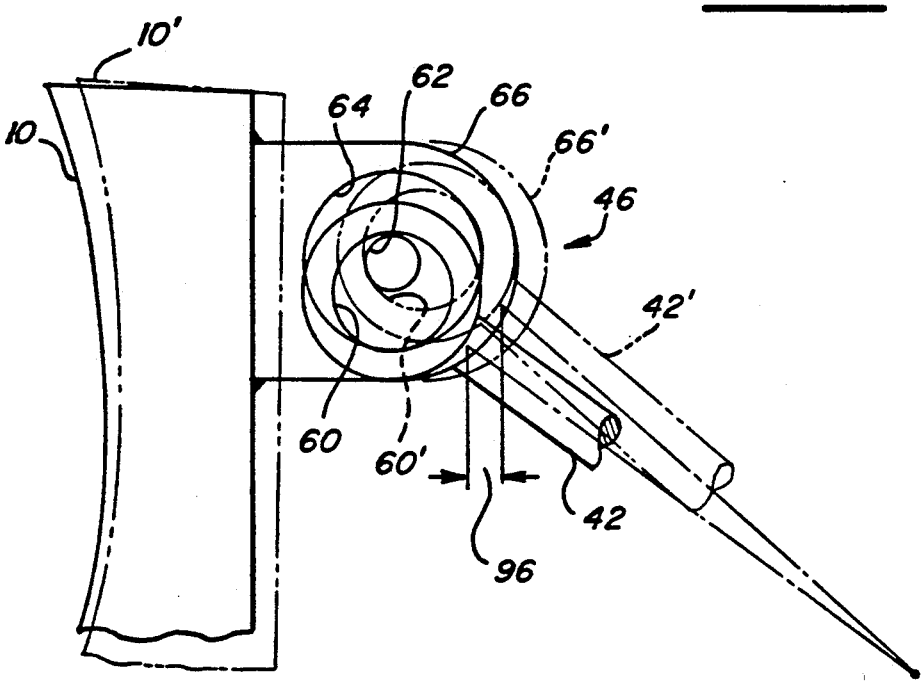
FIG. 6 is a diagrammatic view of the apparatus of the present invention showing its ability to pitch the blade at various inclines.

Now referring to the drawing of FIG. 6, dozer blade 10 is shown in relation to mounting ear 66, cam 46 and second end 42 of cylinder 52 as heretofore described. By rotating cam 46, dozer blade 10 assumes a new position 10'. Other surfaces are translated during the rotation of cam 46, such as eccentric rotational surface 60 which moves to 60', mounting ear 66 which moves to position 66' and second end 42 of cylinder 52 which moves to 42'. Reference numeral 96 depicts the relative horizontal motion of a fixed point located on second end 42 of cylinder 52.

Figure 7:
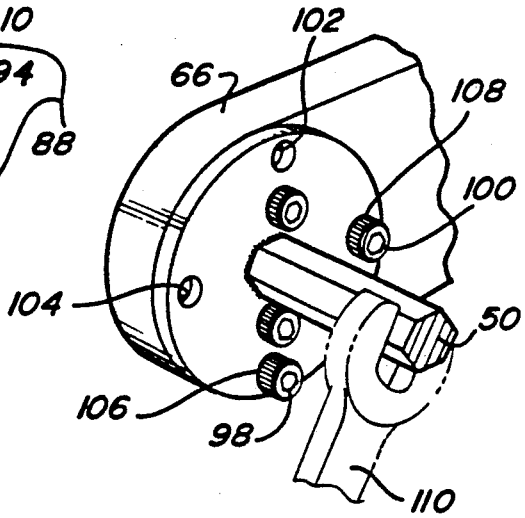
FIG. 7 is a partial isometric view of the apparatus of the present invention depicting how it could be utilized for manually adjusting blade pitch.

Now referring to the drawing of FIG. 7, in an alternative embodiment of the present invention, cylinder 52 can be eliminated, thereby reducing the cost of the disclosed apparatus. Mechanical means can be employed for rotating shaft 50, such as a wrench 110 or the like. If the disclosed invention is to be used without cylinder 52, bolts 98, 100 or some similar fastening means must be used to prevent cams 46, 48 (not shown) from rotating once they have been placed in the proper orientation. One method of achieving this fixation is to place a plurality of holes 102–108 (holes 106 and 108 are not visible because bolt heads 98 and 100 are blocking their view) in arm 74 and at least two holes in ear 66 (holes in ear 66 not visible from this view). If adjustment of pitch is desired, bolts 98, 100 are simply removed, and wrench 110 is used to rotate shaft 50 until blade 10 (not shown) is set at its desired pitch. Once the desired blade pitch is set, shaft 50 is rotated until two of the four holes 102–108 are properly aligned against the two holes in ear 66 to receive bolts 98, 100. It is contemplated that four holes 102–108 spaced ninety degrees apart should give sufficient resolution for most pitch adjustment needs. If four holes do not give sufficient resolution, additional hole sets can be made to accommodate greater pitch resolution settings.

The foregoing detailed description shows that the preferred embodiments of the present invention are well suited to fulfill the objects of the invention. It is recognized that those skilled in the art may make various modifications or additions to the preferred embodiments chosen here to illustrate the present invention, without departing from the spirit of the present invention. For example, cylinder 22 and 52 can be replaced by any manual means such as a turnbuckle, jack screw or the like. It is also contemplated that sufficient structure could be developed such that only one cam is necessary to achieve the disclosed pitching motion independent of blade tilt. For example, cylinder 22 could be mounted to the center of a beam which traverses push beams 14, 16. One end of cylinder 22 would be pivotally mounted intermediate this traversing beam, and the remaining end of cylinder 22 would be mounted to the disclosed cam assembly which would be mounted to the middle of blade 10. Accordingly, it is to be understood that the sought to be afforded hereby should be deemed to extend to the subject matter defined in the appended claims, including all fair equivalents thereof.

I claim:

1. An apparatus for setting the pitch of a bulldozer blade, said bulldozer of the type having two spaced forwardly extending push beams, each said beam respectively associated with and pivotally attached to a respective side of said blade, thereby permitting said blade to pivot about a first axis, comprising:

a first support strut having a first and second end, said first end pivotally attached to said bulldozer, and a first cam having a rotational axis and a first and second surface concentric to said rotational axis and a surface eccentric to said rotational axis and lying between said first and second concentric surfaces, said eccentric surface of said first cam rotatably fastened to said second end of said first strut and said first and second concentric surfaces of said first cam rotatably fastened to said blade spaced from said first axis of said blade, whereby rotating said first cam causes said blade to move relative to said second end of said first support strut, thereby changing the pitch of said blade by causing said blade to rotate about said first axis.

2. The apparatus of claim 1 wherein said first end of said first support strut is pivotally fastened to one of said forwardly extending push beams.

3. The apparatus of claim 2 wherein said first support strut includes a hydraulic cylinder.

4. The apparatus of claim 1 wherein said first cam further includes means coupled between said first cam and said blade for preventing the rotation of said first cam relative to said blade.

5. The apparatus of claim 1 further including means for rotating said first cam.

6. The apparatus of claim 5 wherein said rotating means includes a hydraulic cylinder.

7. The apparatus of claim 1 further including a slave cam, a coupling shaft and a second support strut, said slave cam having a rotational axis and a surface concentric to said rotational axis and a surface eccentric to said rotation axis, said second support strut having first and second ends, said first end of said second support strut pivotally attached to one of said forwardly extending push beams and said second end of said second support strut rotatably fastened to one of said surfaces of said slave cam, the remaining surface of said slave cam rotatably fastened to said blade, and wherein said first end of said first support strut is pivotally fastened to the remaining push beam, and wherein said coupling shaft is joined to said first cam and said slave cam generally in coaxial alignment with each cam's rotational axis, whereby rotating said coupling shaft causes said first cam and said slave cam to rotate, thereby causing said blade to rotate about its first axis, thereby changing the pitch of said blade.

8. The apparatus of claim 7 wherein said first cam includes means coupled between said first cam and said blade for preventing the rotation of said first cam and wherein said slave cam includes means coupled between said slave cam and said blade for preventing the rotation of said slave cam.

9. The apparatus of claim 7, further including means for rotating said first cam, whereby said slave cam also rotates by virtue of its coupling to said first cam by said coupling shaft.

10. The apparatus of claim 9 wherein said rotating means includes a hydraulic cylinder.

11. The apparatus of claim 7 wherein at least one of said support struts comprises a hydraulic cylinder.

* * * * *